US008519306B2

(12) United States Patent
Itoh et al.

(10) Patent No.: US 8,519,306 B2
(45) Date of Patent: Aug. 27, 2013

(54) GLOW PLUG

(75) Inventors: Shinsuke Itoh, Nagoya (JP); Shunsuke Maeda, Nagoya (JP); Masanori Suda, Nagoya (JP); Toshiyuki Matsuoka, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 1188 days.

(21) Appl. No.: 12/412,905

(22) Filed: Mar. 27, 2009

(65) Prior Publication Data

US 2009/0242540 A1 Oct. 1, 2009

(30) Foreign Application Priority Data

Mar. 28, 2008 (JP) ..... 2008-087767
Jan. 5, 2009 (JP) ..... 2009-000323

(51) Int. Cl.
*F23Q 7/22* (2006.01)
*F02B 3/00* (2006.01)

(52) U.S. Cl.
USPC ..... 219/267; 219/270; 219/261; 219/383; 219/552; 219/553; 123/179.21; 123/406.11; 123/594; 123/143 R; 123/146.5 R

(58) Field of Classification Search
USPC ..... 219/267, 270, 261, 383, 552, 553, 219/538, 541–548; 123/179.21, 406.11, 123/594, 143 R, 146.5 R
See application file for complete search history.

(56) References Cited

U.S. PATENT DOCUMENTS

| | | | | |
|---|---|---|---|---|
| 5,877,474 | A * | 3/1999 | Konishi | 219/270 |
| 6,563,089 | B2 * | 5/2003 | Watanabe et al. | 219/270 |
| 6,979,801 | B2 * | 12/2005 | Okazaki et al. | 219/270 |
| 2001/0015402 | A1 * | 8/2001 | Murai et al. | 248/554 |
| 2007/0095811 | A1 | 5/2007 | Last | |

FOREIGN PATENT DOCUMENTS

JP 2007-120939 A 5/2007

* cited by examiner

*Primary Examiner* — Tu B Hoang
*Assistant Examiner* — Ket D Dang
(74) *Attorney, Agent, or Firm* — Sughrue Mion, PLLC

(57) ABSTRACT

A glow plug including a pressure sensor (830) and a heater (150). The glow plug includes a position-defining member which defines the positional relationship between the pressure sensor (830) and the heater (150) and has a coefficient of thermal expansion greater than that of the heater. The pressure sensor (830) is fixed at a predetermined sensor reference position relative to the position-defining member. The heater (150) is held by a heater-holding member (820) in such manner that an attachment position A of the heater-holding member to the heater can be displaced, with a change in external pressure, relative to a predetermined heater reference position defined by the position-defining member. A displacement transmission member (840) is arranged between the heater (150) and the pressure sensor (830) so as to transmit displacement of the heater (150) to the pressure sensor (830). The coefficient of thermal expansion of the displacement transmission member (840) is rendered greater than that of the position-defining member.

10 Claims, 7 Drawing Sheets

LOW TEMPERATURE

HIGH TEMPERATURE (FIRST EMBODIMENT)

HIGH TEMPERATURE (COMPARATIVE EXAMPLE)

LOW TEMPERATURE

HIGH TEMPERATURE
(FIRST EMBODIMENT)

HIGH TEMPERATURE
(COMPARATIVE EXAMPLE)
840d
840a
150
A
810a
830a
820a
800d
800a
AXIAL DIRECTION

GLOW PLUG

BACKGROUND OF THE INVENTION

1. Field of the Invention

The present invention relates to a technique employed in a glow plug for use in a self-ignition-type internal combustion engine so as to detect combustion pressure of the internal combustion engine.

2. Description of the Related Art

Conventionally, a pressure sensor is provided in a glow plug, which assists in startup of a self-ignition-type internal combustion engine such as a diesel engine, so as to detect combustion pressure of the internal combustion engine (refer to, for example, Patent Document 1). In such a glow plug, a pressure sensor is accommodated within a glow plug main body (housing), which is attached to a cylinder head.

[Patent Document 1] Japanese Patent Application Laid-Open (kokai) No. 2007-120939

3. Problems to be Solved by the Invention

The heater of such a glow plug is exposed to the atmosphere within a combustion chamber. Further; the temperatures of the heater and a pressure detection mechanism increase considerably because of heating by the heater and combustion of fuel within the combustion chamber. However, conventionally, such a considerable temperature increase of the pressure detection mechanism has not been taken into consideration. Therefore, various problems may arise, such as a problem in that a load applied to a pressure sensor changes due to the considerable temperature increase of the pressure detection mechanism.

SUMMARY OF THE INVENTION

The present invention has been made in view of the above-mentioned problems. Thus, an object thereof is to provide a glow plug which includes a pressure sensor and in which a change in load applied to the pressure sensor attributable to a temperature change (hereinafter also referred to as a "change in load applied to the pressure sensor") is reduced.

The above object has been achieved by providing, in a first aspect (1) of the invention, a glow plug comprising a pressure sensor and a heater, the glow plug further comprising: a position-defining member which defines a positional relationship between the pressure sensor and the heater and which has a coefficient of thermal expansion greater than that of the heater, wherein the pressure sensor is fixed at a predetermined sensor reference position relative to the position-defining member; the heater is held by a heater-holding member in such manner that an attachment position of the heater-holding member to the heater can be displaced, with a change in external pressure, relative to a heater reference position defined by the position-defining member; and a displacement transmission member whose coefficient of thermal expansion is greater than that of the position-defining member is arranged between the heater and the pressure sensor so as to transmit displacement of the heater to the pressure sensor.

According to the above first aspect of the invention, the coefficient of thermal expansion of the displacement transmission member is rendered greater than that of the position-defining member. Such configuration can compensate for a difference between a change, attributable to a temperature change, in length from the attachment position (of the heater-holding member to the heater) to the pressure sensor and a change in length from the sensor reference position to the heater reference position attributable to thermal expansion of the position-defining member. Since compensation can be performed so as to reduce the difference between changes in the two lengths, the change in load with a change in temperature that is applied to the pressure sensor can be reduced.

In a preferred embodiment (2) of the invention, the glow plug (1) above further comprises: a tubular housing accommodating the presser sensor, the heater being provided at a first end of the housing and being mainly formed of ceramic; and a sensor-holding member fixed to the housing and which accommodates and holds the pressure sensor, wherein the heater-holding member is fixed to the housing, holds the heater, and deforms so as to permit displacement of the attachment position relative to the heater reference position along a direction of an axis connecting first and second ends of the housing, and wherein the sensor-holding member has a coefficient of thermal expansion greater than that of the heater and less than that of the displacement transmission member.

According to (2) above, the coefficient of thermal expansion of the sensor-holding member is rendered greater than that of the heater and less than that of the displacement transmission member, and thereby compensates for the difference in coefficient of thermal expansion between the sensor-holding member and the heater. Specifically, since the heater is mainly formed of a ceramic material, the coefficient of thermal expansion of the heater is small (2 to 8 ppm/° C.). Therefore, the expansion ratio of the heater is small when its temperature increases due to heat generation of the glow plug and operation of an engine. Meanwhile, the sensor-holding member, which constitutes the position-defining member, has a coefficient of thermal expansion greater than that of the heater, and expands by a larger amount when the temperature rises. Therefore, a change in load applied to the pressure sensor attributable to a temperature change increases. However, since the coefficient of thermal expansion of the sensor-holding member is rendered smaller than that of the displacement transmission member that connects the pressure sensor and the heater, the change in the load applied to the pressure sensor can be suppressed. Such a situation occurs not only when the temperature increases but also when the temperature decreases.

In a further preferred embodiment (3) of the glow plug (2) above, the heater-holding member allows for displacement of the attachment position with a change in length of the heater-holding member in the axial direction; and the coefficient of thermal expansion of the heater-holding member is greater than that of the heater and less than that of the displacement transmission member.

In the case where the heater-holding member allows for displacement of the attachment position with a change in length of the heater-holding member in the axial direction, a change in the axial length of the heater-holding member attributable to a temperature change also influences the distance between the sensor reference position and the heater reference position. The coefficient of thermal expansion of the heater-holding member therefore is rendered greater than that of the heater and less than that of the displacement transmission member, so as to more reliably compensate for the difference in coefficient of thermal expansion. Accordingly, a change in the load applied to the pressure sensor attributable to a temperature change can be further suppressed.

In yet another preferred embodiment (4) of the glow plug (2) or (3) above, the sensor-holding member includes a tubular portion accommodated in the housing and fixed to the housing at one end of the tubular portion corresponding to the first end of the housing; and a sensor fixing portion provided at the other end of the tubular portion corresponding to the second end of the housing, and which restricts movement of the pressure sensor at one end of the pressure sensor corresponding to the second end of the housing, to thereby fix the pressure sensor, wherein the displacement transmission member inserted into the tubular portion transmits the displacement to the pressure sensor at the other end of the pressure sensor corresponding to the first end of the housing.

According to the glow plug (4), the increased coefficient of thermal expansion of the displacement transmission member suppresses a decrease in the load applied to the pressure sensor attributable to a temperature rise, which decrease would otherwise occur because of a small coefficient of thermal expansion of the heater.

In yet another preferred embodiment (5) of the glow plug (2) or (3) above, the sensor-holding member includes a tubular portion accommodated in the housing and fixed to the housing at one end of the tubular portion corresponding to the first end of the housing; and a sensor fixing portion provided at the other end of the tubular portion corresponding to the second end of the housing, and which restricts movement of the pressure sensor at one end of the pressure sensor corresponding to the first end of the housing, to thereby fix the pressure sensor, wherein the displacement transmission member inserted into the tubular portion transmits the displacement to the pressure sensor at the other end of the pressure sensor corresponding to the second end of the housing.

According to the glow plug (5), the increased coefficient of thermal expansion of the displacement transmission member suppresses an increase in the load applied to the pressure sensor attributable to a temperature rise, which increase would otherwise occur because of a small coefficient of thermal expansion of the heater.

In yet another preferred embodiment (6) of the glow plug of any of (1) to (5) above, the position-defining member is formed of a low thermal expansion material having a coefficient of thermal expansion of 9 ppm/° C. or less at room temperature.

In this embodiment, a low thermal expansion material having a coefficient of thermal expansion of 9 ppm/° C. or less is employed for the position-defining member. This measure prevents the glow plug, which is mounted on a diesel engine, from becoming excessively long as compared with a glow plug which does not include a pressure sensor. Since a low thermal expansion material having a coefficient of thermal expansion of 9 ppm/° C. or less is selected for the position-defining member, a sufficiently large difference can be produced between the amount of thermal expansion of the position-defining member attributable to a temperature change and that of the displacement transmission member, without the necessity of increasing the absolute length of the position-defining member. Therefore, a glow plug including a pressure sensor can be realized without excessively increasing the overall length of the glow plug.

In yet another preferred embodiment (7) of the glow plug of any of (1) to (6) above, the displacement transmission member is formed of a high thermal expansion material having a coefficient of thermal expansion of 16 ppm/° C. or greater at room temperature.

In this embodiment, a high thermal expansion material having a coefficient of thermal expansion of 16 ppm/° C. or greater is employed for the displacement transmission member. This measure prevents the glow plug, which is mounted on a diesel engine, from becoming excessively long as compared with a glow plug which does not include a pressure sensor. Since a high thermal expansion material having a coefficient of thermal expansion of 16 ppm/° C. or greater is selected for the displacement transmission member, a sufficiently large difference can be produced between the amount of thermal expansion of the position-defining member attributable to a temperature change and that of the displacement transmission member, without the necessity of increasing the absolute length of the displacement transmission member. Therefore, a glow plug including a pressure sensor can be realized without excessively increasing the overall length of the glow plug.

In yet another preferred embodiment (8) of the glow plug of any of (2) to (7) above, the housing includes a fastening portion for attachment to an internal combustion engine; and the sensor-holding member is fixed at a position between the fastening portion and the first end of the housing.

Since the sensor-holding member is disposed on the heater side in relation to the fastening portion for attaching the housing to the internal combustion engine, the distance between the heater and the pressure sensor can be reduced. Therefore, the influence of vibration generated as a result of operation of the internal combustion engine on pressure detection can be reduced. Meanwhile, when the sensor-holding member is disposed on the heater side in relation to the fastening portion, the temperature rise of the sensor-holding member becomes greater. According to embodiment (8), due to compensating for the difference in coefficient of thermal expansion between the sensor-holding member and the heater, the influence of vibration on the pressure detection can be reduced, and the influence of temperature rise can be reduced.

Notably, the present invention can be realized in various forms. For example, the present invention can be realized in the form of a glow plug, a startup assisting apparatus for an internal combustion engine which uses the glow plug, an internal combustion engine which uses the startup assisting apparatus, or a movable body using the internal combustion engine.

DESCRIPTION OF REFERENCE NUMERALS

Figure 1:
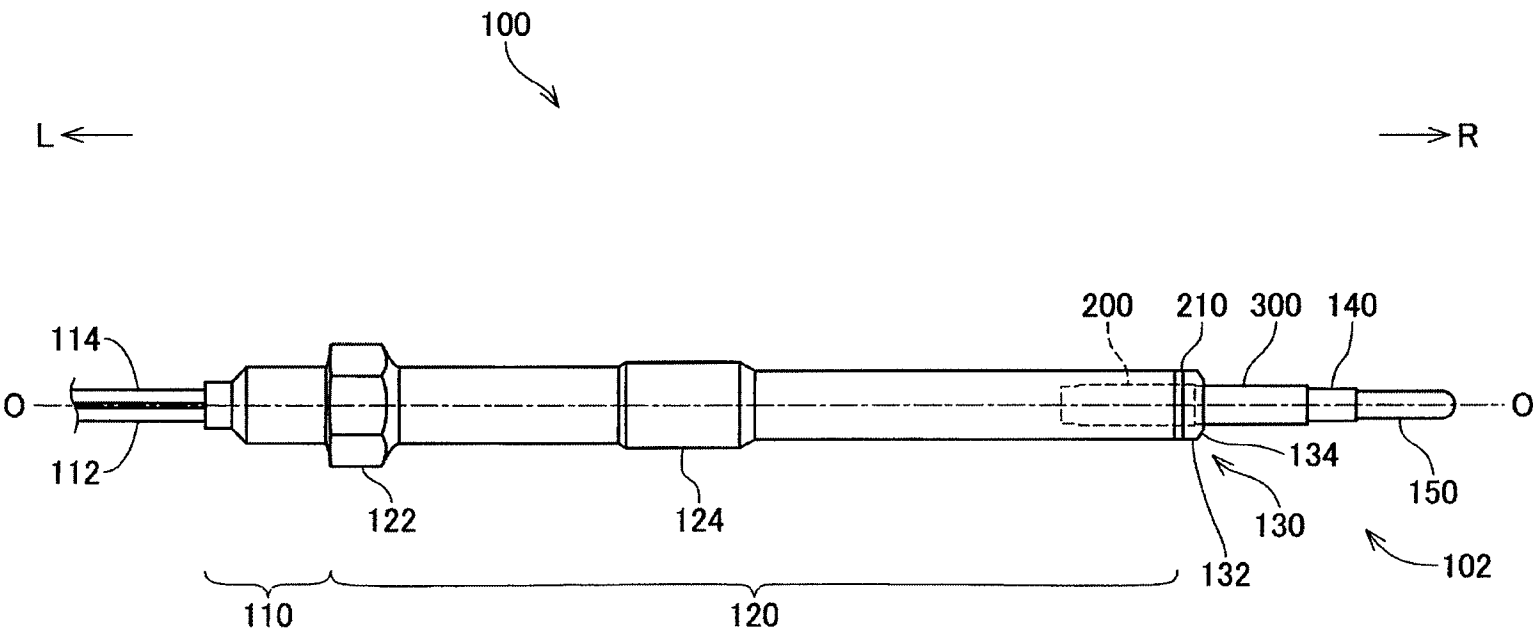
FIG. 1 is an external view showing the appearance of a glow plug, which is one embodiment of the present invention.

Reference numerals used to identify various structural features in the drawings include the following.

100, 100*a* . . . glow plug
102, 102*a* . . . front-end structure
110 . . . wire-holding section
112 . . . sensor cable
114 . . . electricity supply cable
120 . . . metallic shell
122 . . . engagement portion
124 . . . screw portion

130 . . . front-end chip
132 . . . cylindrical portion
134 . . . taper portion
140 . . . outer tube
150 . . . heater
152 . . . insulative portion
154 . . . conductive portion
156, 158 . . . exposed portion
200 . . . front-end sleeve
202 . . . metallic shell abutment portion
210 . . . flange portion
220 . . . membrane attachment portion
230 . . . cylindrical portion
240 . . . sensor attachment portion
300 . . . membrane
310 . . . sleeve attachment portion
320 . . . sleeve abutment portion
330 . . . thin-wall portion
340 . . . outer tube holding portion
400 . . . ring
500, 500*a* . . . center shaft
510, 510*a* . . . taper portion
520, 520*a* . . . mating portion
530, 530*a* . . . trunk portion
540 . . . sensor abutment portion
550*a* . . . shaft portion
600, 600*a* . . . sensor element
610 . . . sensor casing
610*a* . . . element member base
612, 612*a* . . . sleeve joint portion
614 . . . cylindrical portion
620, 660 . . . insulative block
620*a*, 660*a* . . . insulative block
630, 650 . . . electrode block
630*a*, 650*a* . . . electrode plate
640, 640*a* . . . sensor element
670, 670*a* . . . element-retaining member
672*a* . . . larger diameter portion
674*a* . . . smaller diameter portion
800 . . . pressure detection mechanism
800*a* . . . pressure detection mechanism
800*c* . . . pressure detection mechanism
800*d* . . . pressure detection mechanism
810, 810*a* . . . sensor-holding member
820, 820*a* . . . heater-holding member
830, 830*a* . . . pressure sensor
840, 840*a*, 840*c*, 840*d* . . . displacement transmission member

DETAILED DESCRIPTION OF THE PREFERRED EMBODIMENTS

The present invention will next be described in greater detail in the following order and by reference to the drawings. However, the present invention should not be construed as being limited thereto.

A. First Embodiment
A1. Structure of a Glow Plug
A2. Configuration of a Front-End Structure
A3. Influence of Temperature Rise on a Pressure Detection Mechanism
B. Second Embodiment
B1. Front-End Structure According to the Second Embodiment
B2. Influence of Temperature Rise in the Second Embodiment A1. Glow Plug Structure FIG. 1 is an outside view showing the appearance of a glow plug, which is one embodiment of the present invention. The glow plug denoted by 100 includes a wire-holding section 110, a metallic shell 120, a front-end sleeve 200, a front-end tip 130, a membrane 300, an outer tube 140 and a heater 150.

The wire-holding section 110 holds a sensor cable 112 which outputs to an external device an output signal of a pressure sensor (described below) disposed in the glow plug 100, and a power supply cable 114 which supplies electric power to the heater 150. In the wire-holding section 110, a plurality of conductors of the sensor cable 112 are connected to a plurality of sensor signal wires (not shown) connected to the pressure sensor. Further, a conductor of the power supply cable 114 is connected to a center shaft (described below) adapted to supply electric power to the heater 150.

The metallic shell 120 is a tubular member, and is attached to a cylinder head of a self-ignition-type internal combustion engine such as a diesel engine. In the first embodiment, the metallic shell 120 is formed of carbon steel (S45C). However, various materials such as stainless steel (e.g., SUS630 and SUS430) can be used for the metallic shell 120, so long as the selected material has high strength. The metallic shell 120 has an engagement portion 122 formed at an end portion thereof located on the side toward the wire-holding section 110. A tool is engaged with the engagement portion 122 when the glow plug 100 is attached to the cylinder head. The metallic shell 120 has, at its intermediate portion, a screw portion 124 for fixing the glow plug 100 to the cylinder head. The screw portion 124 is screwed into the cylinder head when a worker rotates the engagement portion 122 by use of a tool, whereby the glow plug 100 is attached to the cylinder head. As a result, the heater 150 of the glow plug 100 is exposed to the interior of a combustion chamber of the internal combustion engine. In the following description, a direction (a direction of arrow R) along an axis O and toward the heater 150 side will be referred to as the "front-end side" and a direction (a direction of arrow L) along the axis O and toward the wire-holding section 110 side will be referred to as the "rear-end side."

The front-end tip 130 is a tubular member formed of SUS 430. Notably, the front-end tip 130 may be formed of carbon steel or another stainless steel. The front-end tip 130 has a cylindrical portion 132 which has a substantially constant outer diameter along the axis O, and a taper portion 134 whose outer diameter decreases toward the front-end side. By providing the taper portion 134, when the glow plug is screwed into the cylinder head, the front-end tip 130 presses and deforms a taper seat surface provided on the cylinder head, to thereby secure air-tightness of the combustion chamber.

The front-end sleeve 200 is a tubular member having a flange portion 210, and a portion other than the flange portion 210 is accommodated within the metallic shell 120 and the front-end tip 130. In the first embodiment, the front-end sleeve 200 is formed of ferritic stainless steel (SUS430) having a low coefficient of thermal expansion (linear expansion). Notably, the front-end sleeve 200 may be formed of any of various materials which are high in strength and low in coefficient of thermal expansion. A material having a low coefficient of thermal expansion can be selected on the basis of, for example, a coefficient of thermal expansion at room temperature (25° C.) (hereinafter also referred to as a "room-temperature thermal expansion coefficient"). Notably, a method of measuring the coefficient of thermal expansion will be described below. In addition to SUS430 (room-temperature thermal expansion coefficient: 10.4 ppm/° C.), other ferritic stainless steels, such as SUS405 (room-temperature thermal expansion coefficient: 10.8 ppm/° C.), and precipitation hardening stainless steels, such as SUS630 (room-temperature thermal expansion coefficient: 10.8 ppm/° C.) can be used so as to form the front-end sleeve 200. Notably, more preferably, a material (low thermal expansion material) whose room-temperature thermal expansion coefficient is equal to 9 ppm/° C. or less is used as a material having a low coefficient of thermal expansion. For example, a nickel (Ni) alloy such as KOVAR (trademark of Carpenter Technology Corporation) whose room-temperature thermal expansion coefficient is 5 ppm/° C. or NILO (trademark of Special Metals Wiggin Limited); or tungsten whose room-temperature thermal expansion coefficient is 4.3 ppm/° C. can be used as the low thermal expansion material. The flange portion 210 of the front-end sleeve 200 is welded while being sandwiched between the metallic shell 120 and the front-end tip 130. As a result, the metallic shell 120, the front-end sleeve 200 and the front-end tip 130 are fixedly joined. Notably, a low thermal expansion material other than metal can be used for the front-end sleeve 200 depending on the method of fixing the metallic shell 120, the front-end sleeve 200 and the front-end tip 130. For example, silicon nitride (SiN) whose room-temperature thermal expansion coefficient is 3.5 ppm/° C. can be used for the front-end sleeve 200. In this case, the front-end sleeve 200 may be fixed such that the outer diameter of the flange portion 210 is rendered smaller than the outer diameter of the metallic shell, an outer circumferential portion of the front-end tip 130 is extended toward the rear-end side by an amount corresponding to the thickness of the flange portion 210, and the front-end tip 130 and the metallic shell 120 are directly joined to each other.

The membrane 300 is a tubular member formed of SUS630. Instead of SUS630, the membrane 300 may be formed from any of various materials which are high in fatigue strength and low in Young's modulus of elasticity (e.g., maraging steel, SUS430, pure titanium, titanium alloy (Ti-6Al-4V)). The membrane 300 is welded to the front-end sleeve 200 within the metallic shell 120. Notably, more preferably, the membrane 300 is formed of a metal having a low coefficient of thermal expansion as in the case of the front-end sleeve.

The outer tube 140 is a tubular member formed of SUS630. Instead of SUS630, the outer tube 140 may be formed from any of materials of high strength such as carbon steel (e.g., S45C) and other stainless steels (e.g., SUS430). The heater 150 is press-fitted into the outer tube 140. The outer tube 140 including the heater 150 press-fitted thereinto is press-fitted into the membrane 300 joined to the front-end sleeve 200. In this manner, the heater 150 is joined to the metallic shell 120 via the outer tube 140, the membrane 300 and the front-end sleeve 200.

The front-end sleeve 200, the membrane 300, the outer tube 140, the heater 150 and various unillustrated members form a single structure (front-end structure) 102. As described above, the flange portion 210 of the front-end sleeve 200 is fixedly joined to the metallic shell 120 and the front-end tip 130. Therefore, the front-end structure 102 is fixedly joined to the metallic shell 120 and the front-end tip 130 (also collectively called the "housing").

A2. Configuration of the Front-End Structure

Figure 2:
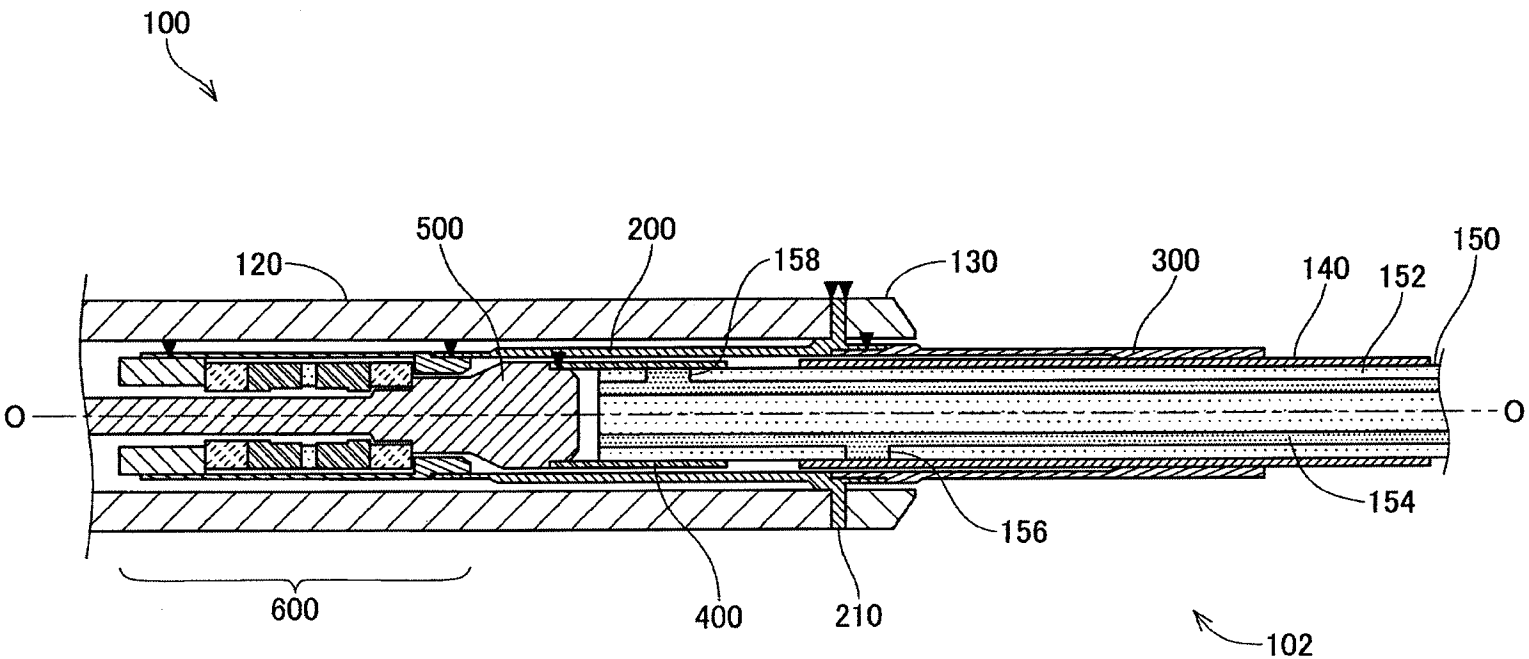
FIG. 2 is a sectional view showing the configuration of a front-end structure attached to the front end of a metallic shell.

FIG. 2 is a sectional view showing the configuration of the front-end structure. The front-end structure 102 is composed of the front-end sleeve 200, the membrane 300, the outer tube 140, the heater 150, a ring 400, a center shaft 500 and a sensor unit 600. Of these components, the front-end sleeve 200, the membrane 300, the outer tube 140, the ring 400 and the center shaft 500 are formed of metal (stainless steel). Therefore, the front-end structure 102 supplies electric current to the heater 150. The front-end structure 102 also functions as a pressure detection mechanism for detecting the pressure within the combustion chamber. Notably, the specific configurations of the members which constitute the front-end structure 102, and the function of the front-end structure 102 as a pressure detection mechanism will be described below.

The heater 150 includes an insulative portion 152 formed of an insulative ceramic, and two conductive portions 154 formed of an electrically conductive ceramic. The two conductive portions 154 extend from the rear end of the heater 150 toward the front end thereof, and are connected together at the front end side of the heater 150. The conductive portions 154 have two exposed portions 156 and 158 exposed to the outer circumference of the heater 150. The front-end-side exposed portion 156 is electrically connected to the metallic shell 120 via the outer tube 140, the membrane 300 and the front-end sleeve 200. The rear-end-side exposed portion 158 is electrically connected to the electric current supply cable 114 (FIG. 1) via the ring 400 and the center shaft 500. Therefore, when a voltage is applied between the metallic shell 120 and the electric current supply cable 114, current flows through the conductive portions 154, whereby the heater 150 generates heat.

Figure 3:
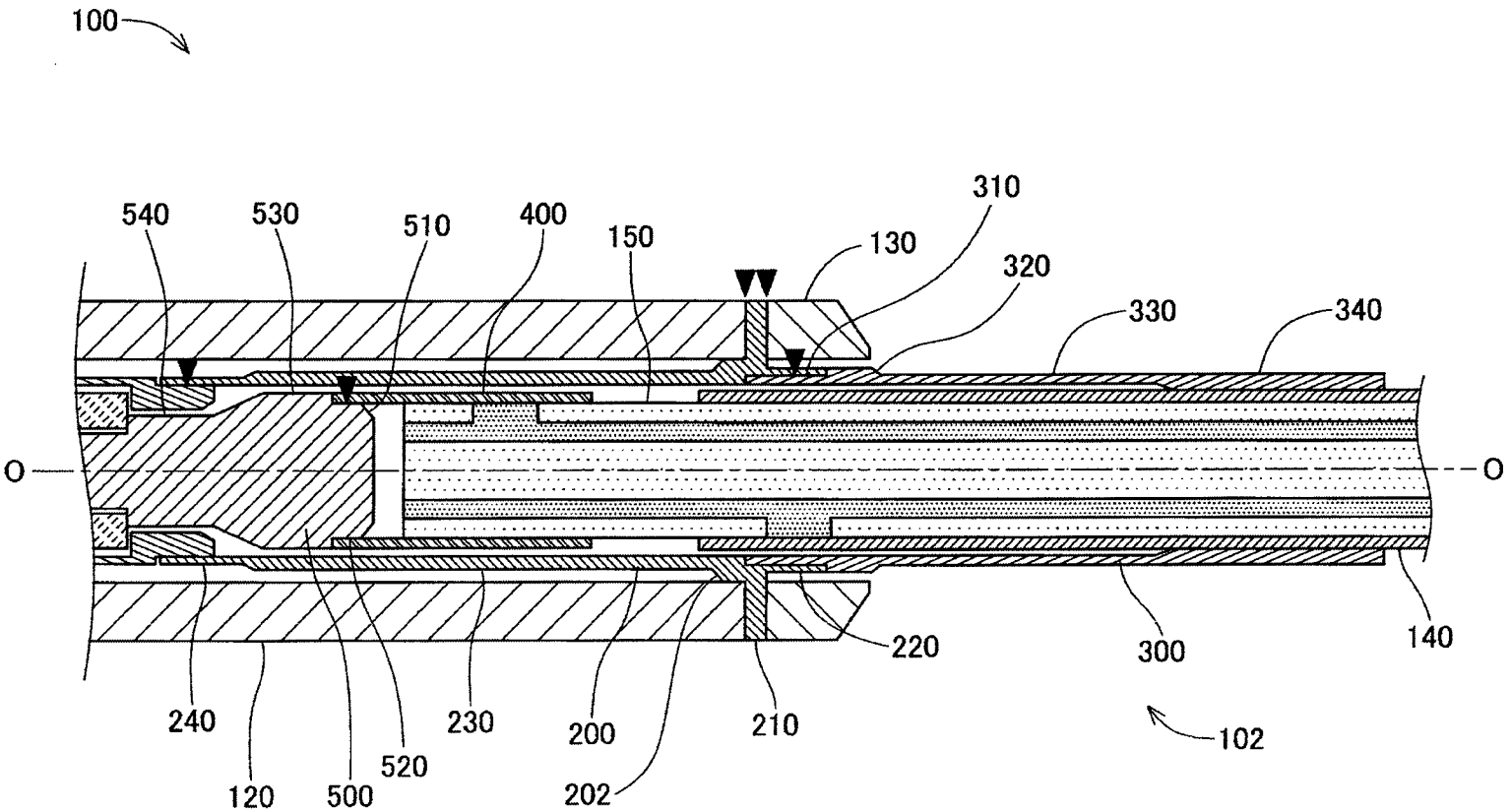
FIG. 3 is an enlarged sectional view showing, on an enlarged scale, the front end side of the front-end structure.
Figure 4:
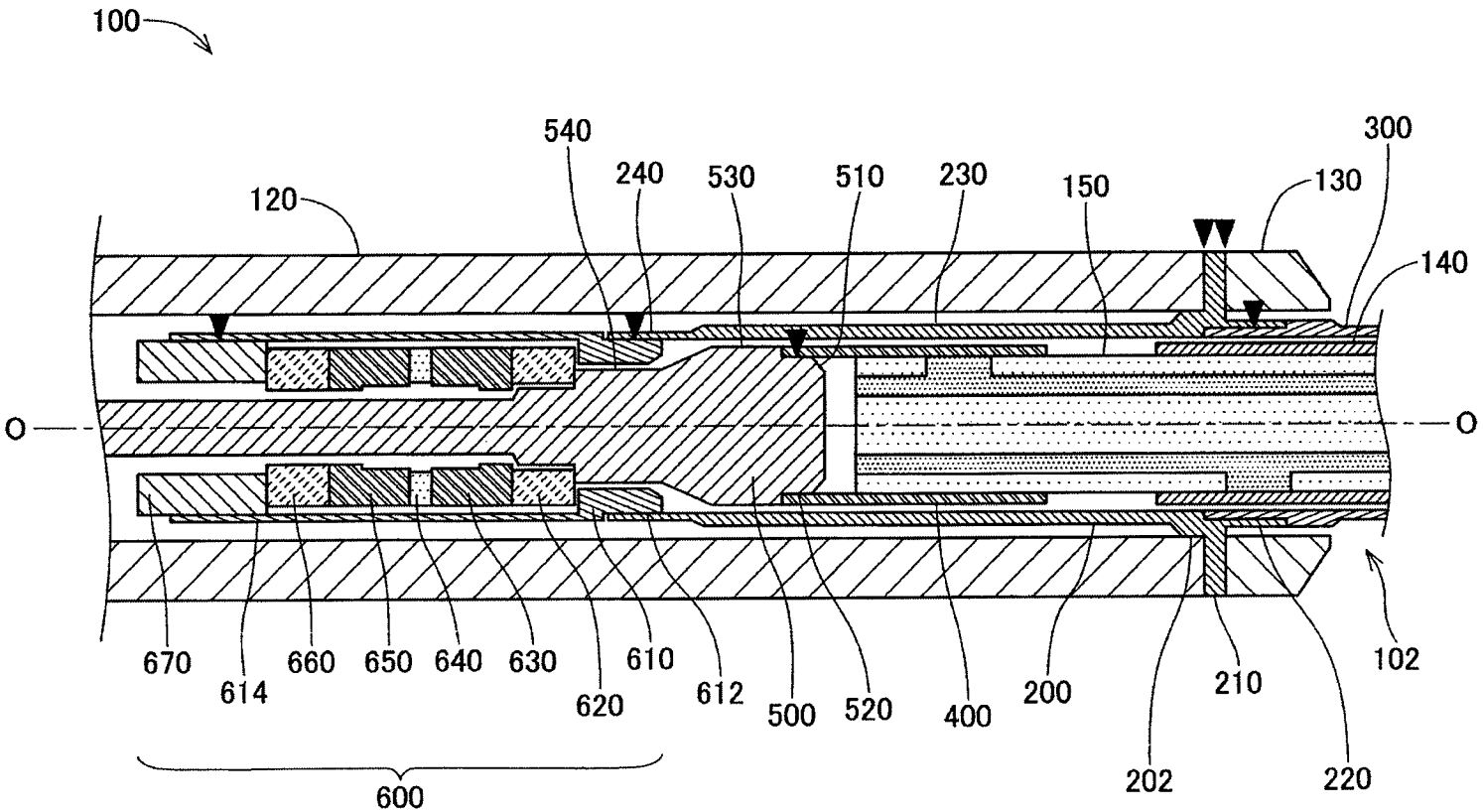
FIG. 4 is an enlarged sectional view showing, on an enlarged scale, the rear end side of the front-end structure.

FIGS. 3 and 4 are enlarged sectional views of the front-end side and the rear-end side of the front-end structure 102. As described above, the front-end sleeve 200 has the flange portion 210, which is attached to the metallic shell 120. The flange portion 210 assumes the form of a flat plate extending in a direction (radial direction) perpendicular to the axis O. The front-end sleeve 200 includes a metallic shell abutment portion 202 which comes into contact with the inner circumferential surface of the metallic shell 120. As a result of the metallic shell abutment portion 202 coming into contact with the inner circumferential surface of the metallic shell 120, the front-end sleeve 200 is disposed coaxially with the metallic shell 120.

As described above, the front-end sleeve 200, the metallic shell 120 and the front-end tip 130 are joined together by means of welding. Specifically, laser welding is performed from the radially outer side at positions indicated by black triangles in FIG. 3, whereby the front-end sleeve 200, the metallic shell 120 and the front-end tip 130 are welded together. Notably, the method of joining the front-end sleeve 200, the metallic shell 120, and the front-end tip 130 is not limited to laser welding. For example, the members 200, 120 and 130 may be joined through electron beam welding, resistance welding, arc spot welding, or brazing.

The front-end sleeve 200 includes a membrane attachment portion 220 which is provided on the front-end side of the flange portion 210 and whose inner diameter is larger than those of the remaining portions. Further, the front-end sleeve 200 includes a cylindrical portion 230 and a sensor attachment portion 240 formed on the rear-end side of the flange portion 210. The cylindrical portion 230 has an outer diameter approximately equal to that of the membrane attachment portion 220. The sensor attachment portion 240 has an outer diameter smaller than that of the cylindrical portion 230. Both the outer diameters of the membrane attachment portion 220 and the cylindrical portion 230 are smaller than the inner diameters of the metallic shell 120 and the front-end tip 130. Notably, in the present embodiment, the cylindrical portion 230 and the sensor attachment portion 240 are constituted by separate members. However, the cylindrical portion 230 and the sensor attachment portion 240 may be constituted by a single member.

The membrane 300 is joined to the membrane attachment portion 220 of the front-end sleeve 200. The membrane 300 includes a sleeve attachment portion 310, a sleeve abutment portion 320, a thin-wall portion 330 and an outer tube holding portion 340, which are formed in this sequence from the rear-end side toward the front-end side. Both the inner diameters of the sleeve attachment portion 310 and the sleeve abutment portion 320 are greater than the outer diameter of the outer tube 140. The outer diameter of the sleeve attachment portion 310 is rendered approximately equal to the inner diameter of the membrane attachment portion 220 such that the sleeve attachment portion 310 can be fitted into the membrane attachment portion 220 of the front-end sleeve 200. The outer diameter of the sleeve abutment portion 320 is rendered approximately equal to the outer diameter of the membrane attachment portion 220, whereby the positional relationship between the front-end sleeve 200 and the membrane 300 along the axis O is defined. The front-end sleeve 200 and the membrane 300 are joined by means of laser welding performed from the radially outer side of the sleeve attachment portion 310 at a position indicated by a black triangle in a state in which the sleeve attachment portion 310 is fitted into the membrane attachment portion 220. Notably, the front-end sleeve 200 and the membrane 300 may be joined by a different method. For example, the front-end sleeve 200 and the membrane 300 may be joined by means of welding of a different type such as arc spot welding, or brazing.

The thin-wall portion 330 is a tubular member whose outer diameter is smaller than the outer diameter of the sleeve abutment portion 320 and whose inner diameter is greater than that of the outer diameter of the outer tube 140. The outer tube holding portion 340 is a tubular member whose outer diameter is approximately equal to that of the outer diameter of the thin-wall portion 330 and whose inner diameter is approximately equal to the outer diameter of the outer tube 140. The outer tube 140 including the press-fitted heater 150 is press-fitted into the outer tube holding portion 340. Notably, although the joining between the heater 150 and the outer tube 140 and the joining between the outer tube 140 and the outer tube holding portion 340 are each carried out by press-fitting and laser welding performed at a position where two members overlap, the joining may be performed using other methods such as brazing.

The cylindrical ring 400 is press-fitted onto the rear end of the heater 150. The inner diameter of the ring 400 is approximately equal to the outer diameter of the heater 150. The center shaft 500 is joined to the rear end of the ring 400. The center shaft 500 is formed of an austenitic stainless steel having a large coefficient of thermal expansion (e.g., SUS304 whose room-temperature thermal expansion coefficient is 17.3 ppm/° C.). However, the center shaft 500 may be formed of any of other metallic materials (e.g., another austenitic stainless steel SUS316), so long as the selected metallic material has a relatively high strength and a large coefficient of thermal expansion. More preferably, a high thermal expansion material whose room-temperature thermal expansion coefficient is 16 ppm/° C. or greater is used as a material having a large coefficient of thermal expansion. Further, the ring 400 is formed of SUS630.

The center shaft 500 includes a taper portion 510, a mating portion 520, a trunk portion 530 and a sensor abutment portion 540. The mating portion 520 has an outer diameter approximately equal to the inner diameter of the ring 400 (that is, the outer diameter of the heater 150). Since the taper portion 510 is provided on the front-end side of the mating portion 520 such that the outer diameter decreases toward the front-end side, the center shaft 500 can be readily inserted into the ring 400. The trunk portion 530 has an outer diameter approximately equal to the outer diameter of the ring 400. Therefore, when the center shaft 500 is inserted into the ring 400, the ring 400 abuts against the trunk portion 530, whereby the positional relationship between the center shaft 500 and the ring 400 along the axis O is defined. Notably, the center shaft 500 and the ring 400 are joined by means of laser welding performed from the radially outer side of the ring 400 at a position indicated by a black triangle after the mating portion 520 is inserted into the ring 400. Notably, the center shaft 500 and the ring 400 may be joined by means of welding of a different type such as arc spot welding, or brazing.

As shown in FIG. 4, the sensor unit 600 is provided on the rear-end side of the front-end sleeve 200. The sensor unit 600 includes a sensor casing 610, a first insulative block 620, a first electrode block 630, a sensor element 640, a second electrode block 650, a second insulative block 660 and an element-retaining member 670.

The sensor casing 610 is a tubular member formed of SUS430 having a small coefficient of thermal expansion. The sensor casing 610 has a sleeve joint portion 612 whose outer diameter is approximately equal to the inner diameter of the sensor attachment portion 240 of the front-end sleeve 200. The sensor casing 610 is joined to the front-end sleeve 200 by means of welding performed from the radially outer side of the sensor attachment portion 240 at a position indicated by a black triangle in a state in which the sleeve joint portion 612 is inserted into the sensor attachment portion 240. Notably, in the first embodiment, since the wall thickness of the sensor attachment portion 240 is reduced, the welding between the sleeve joint portion 612 and the sensor attachment portion 240 can be readily performed.

The sensor casing 610 has a cylindrical portion 614 formed at the rear-end side thereof. The first insulative block 620, the first electrode block 630, the sensor element 640, the second electrode block 650 and the second insulative block 660 are inserted into the cylindrical portion 614 in this sequence from the front-end side thereof.

The sensor element 640 is a disk-shaped member formed of lithium niobate, so that a charge (sensor output signal) corresponding to a stress along the axis O is generated. Notably, the sensor element 640 may be formed of any of piezoelectric materials (e.g., quartz), other than lithium niobate, so long as the electrical characteristic of the formed element changes in accordance with stress. Further, the sensor element 640 may be formed of a piezoresistance material. In this case, the structure around the sensor element 640 is properly modified so as to be compatible with use of the piezoresistance material.

The electrode blocks 630 and 650 are tubular members formed of SUS430. Sensor signal wires (not shown) connected to the sensor cable 112 (FIG. 1) are connected to the two electrode blocks 630 and 650, respectively. A charge generated at the sensor element 640, which serves as a pressure sensor, is output to the outside of the glow plug 100 via the electrode blocks 630 and 650, the sensor signal wires and the sensor cable 112. This configuration may be modified such that the generated charge is converted to a voltage signal by a circuit (not shown) provided within the metallic shell 120, and the voltage signal is output to an external device. Notably, the electrode blocks 630 and 650 may be formed of any of other materials which are electrically conductive and are high in strength. Further, in place of the electrode blocks 630 and 650, disk-shaped electrode plates may be used.

The insulative blocks 620 and 660 are tubular members formed of alumina. The front end of the first insulative block 620 is in contact with the rear end of the sensor abutment portion 540 of the center shaft 500. Notably, instead of using alumina, the insulative blocks 620 and 660 may be formed of any of other materials which are electrically insulative and are high in strength, such as zirconia and silicon nitride.

The element-retaining member 670 is a tubular member formed of SUS430. Instead of using SUS430, the element-retaining member 670 may be formed of any of materials of high strength, such as carbon steel and other types of stainless steel. The outer diameter of the element-retaining member 670 is approximately equal to the inner diameter of the cylindrical portion 614 of the sensor casing 610. The element-retaining member 670 and the cylindrical portion 614 are joined through laser welding performed from the radially outer side of the cylindrical portion 614 at a location indicated by a black triangle in a state in which a load (called a "pre-load") directing toward the front end is applied to the element-retaining member 670. Thus, the sensor element 640 is maintained in a state in which the pre-load is applied to the sensor element 640. Notably, the joining between the element-retaining member 670 and the cylindrical portion 614 may be performed by any of other methods such as arc spot welding and brazing.

The glow plug 100 (FIG. 1) fabricated as described above is attached to the cylinder head of the internal combustion engine so as to detect the pressure within the combustion chamber of the internal combustion engine. When the pressure within the combustion chamber changes, the thin-wall portion 330 of the membrane 300 deforms, and the heater 150 displaces along the axis O in relation to the metallic shell 120. Meanwhile, the sensor element 640 is fixed to the metallic shell 120 via the second electrode block 650, the second insulative block 660, the element-retaining member 670, the sensor casing 610 and the front-end sleeve 200. Therefore, when the heater displaces, the overall length of the ring 400, the center shaft 500, the first insulative block 620 and the sensor element 640 changes. With the change in length, stress acting on the respective members 400, 500, 620 and 640 also changes. In this manner, the load acting on the sensor element 640 changes in accordance with displacement of the heater 150 in relation to the metallic shell 120. The sensor element 640 formed of a piezoelectric material generates a charge corresponding to displacement of the heater 150. The generated charge is output to an external device via the electrode blocks 630 and 650, the unillustrated sensor signal wires and the sensor cable 112, the sensor cable 112 being connected to the sensor signal wires within the wire-holding section 110 (FIG. 1).

Notably, in the first embodiment, the positional relationship between the heater 150 and the sensor element 640 is defined by assembling the heater 150 and the sensor element 640 into a tubular member (outer shell) formed by the membrane 300, the front-end sleeve 200, and the sensor casing 610. Therefore, the outer shell serves as a position-defining member for defining the positional relationship between the heater 150 and the sensor element 640. However, in general, the heater 150 and the sensor element 640 need not necessarily be assembled into the outer shell, so long as the positional relation between the heater 150 and the sensor element 640 can be defined. For example, the front-end sleeve 200 and the membrane 300 may be individually attached to the housing. In this case, the membrane 300, the housing, the front-end sleeve 200 and the sensor casing 610 correspond to the position-defining member.

A3. Influence of Temperature Rise on the Pressure Detection Mechanis

The glow plug 100 is attached to the cylinder head of the internal combustion engine. The heater 150 generates heat so as to increase the temperature within the combustion chamber, to thereby assist startup of the internal combustion engine. Also, the temperature of the glow plug 100 increases as the temperature of the cylinder head increases. This is a result of heating by the heater 150 and operation of the internal combustion engine. In particular, the temperature of the front-end structure 102 (FIG. 2), including the heater 150, increases considerably as a result of heating by the heater 150 and combustion of fuel within the combustion chamber.

Figure 5A:
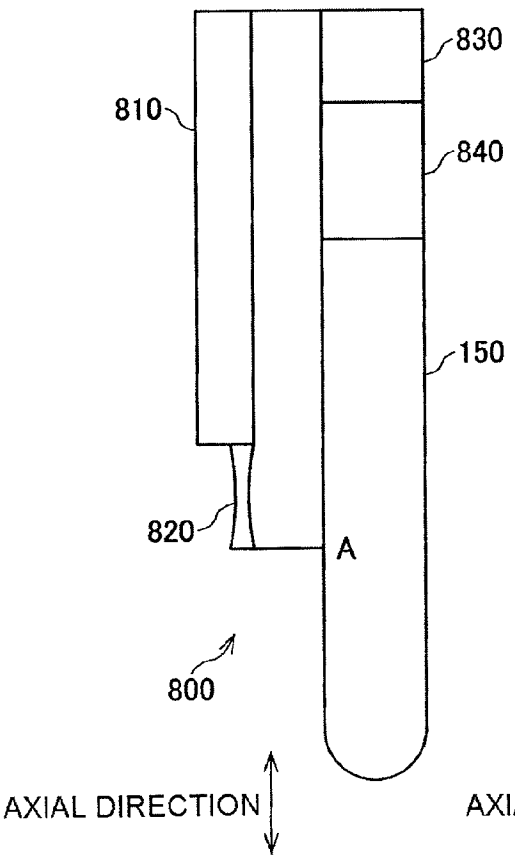
FIG. 5(*a*)-5(*c*) are explanatory views schematically showing the influence of temperature rise of the glow plug on a pressure detection mechanism.
Figure 5B:
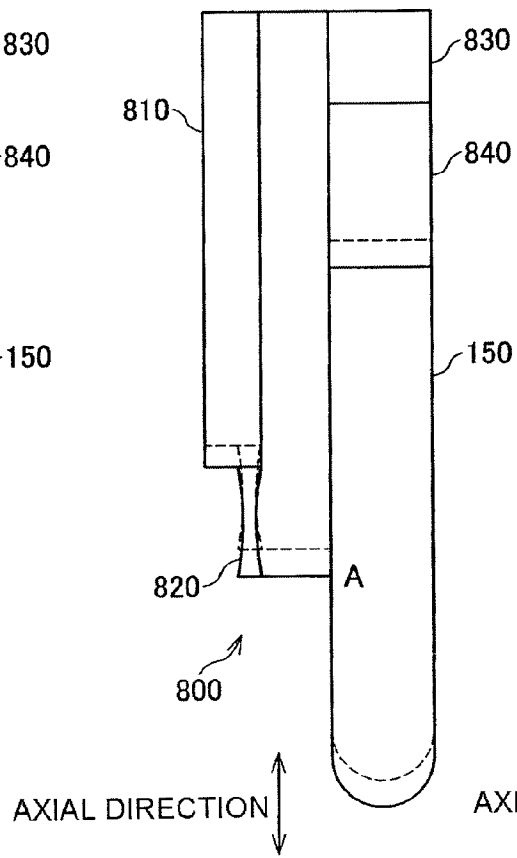
Figure 5C:
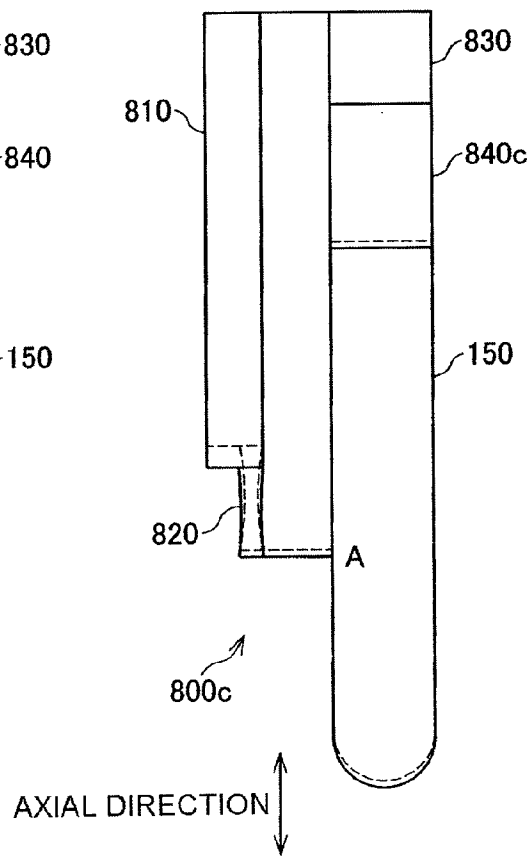

FIGS. 5(*a*) to 5(*c*) are explanatory views schematically showing the influence of temperature rise of the glow plug on a pressure detection mechanism. To facilitate understanding, FIGS. 5(*a*) to 5(*c*) show pressure detection mechanisms 800 and 800*c*, which correspond to the font-end structure 102 (FIG. 2) but are simplified. FIG. 5(*a*) shows the state of the pressure detection mechanism 800 of the first embodiment at a low temperature. FIG. 5(*b*) shows the state of the pressure detection mechanism 800 of the first embodiment at a high temperature (solid lines) and the state of the pressure detection mechanism 800 at the low temperature (broken lines). FIG. 5(*c*) shows the state of the pressure detection mechanism 800*c* of a comparative example at a high temperature (solid lines) and the state of the pressure detection mechanism 800*c* at the low temperature (broken lines).

As shown in FIG. 5(*a*), the pressure detection mechanism 800 of the first embodiment is mainly composed of a sensor-holding member 810, a heater-holding member 820, a pressure sensor 830, a displacement transmission member 840 and a heater 150 mainly formed of ceramic. The pressure sensor 830 is a member which outputs a signal in accordance with a load applied to the pressure sensor 830, and corresponds to the sensor element 640 shown in FIG. 4.

The sensor-holding member 810 fixes, at its rear end, the position of the rear end of the pressure sensor 830, to thereby restrict movement of the pressure sensor 830 along the axial direction (the direction of the axis O in FIG. 4). This sensor-holding member 810 roughly corresponds to the front-end sleeve 200 and the sensor casing 610 shown in FIG. 4.

The heater-holding member 820 attached to the front end of the sensor-holding member 810 holds the heater 150 at an attachment position A located at an intermediate portion thereof (corresponding to the rear end of the outer-tube holding portion 340 of FIG. 3), and permits movement of the heater 150 along the axial direction by deformation of the heater-holding member 820 itself. The heater-holding member 820 roughly corresponds to the membrane 300 shown in FIG. 3.

The displacement transmission member 840 is joined to the rear end of the heater 150. The rear end of the displacement transmission member 840 is in contact with the pressure sensor 830. By virtue of this configuration, the displacement transmission member 840 transmits an axial displacement of the heater 150 to the pressure sensor 830. The displacement transmission member 840 roughly corresponds to the ring 400 shown in FIG. 4 and a portion of the center shaft 500 shown in FIG. 4, the portion extending from the trunk portion 530 to the sensor abutment portion 540. The coefficient of thermal expansion of the displacement transmission member 840 is rendered greater than that of the sensor-holding member 810.

As described above, when the front-end structure 102; i.e., the pressure detection mechanism 800, is formed, a predetermined pre-load is applied to the pressure sensor 830. The pre-load is transmitted to the heater-holding member 820 via the displacement transmission member 840 and the heater, so that a frontward force corresponding to the pre-load acts on the front end of the heater-holding member 820. As a result of application of force to the heater-holding member 820, the heater-holding member 820 is maintained in an axially extended state as shown in FIG. 5(*a*).

When the temperature increases from the low temperature state shown in FIG. 5(*a*), as shown in FIG. 5(*b*), the members which constitute the pressure detection mechanism 800 thermally expand. In general, ceramic materials which constitute the heater 150 and the pressure sensor 830 have coefficients of thermal expansion smaller than those of metals which constitute the sensor-holding member 810 and the displacement transmission member 840. Therefore, elongation of the sensor-holding member 810 due to the temperature rise is greater than that of a portion of the heater 150, the portion extending rearward from the attachment position A at which the heater 150 is attached to the heater-holding member 820. In the pressure detection mechanism 800 of the first embodiment, the coefficient of thermal expansion of the displacement transmission member 840 is rendered greater than that of the sensor-holding member 810. Therefore, elongation of the sensor-holding member 810 is suppressed, and elongation of the displacement transmission member 840 increases. Thus, even at high temperature, the length as measured from the rear end of the sensor-holding member 810 to the front end of the heater-holding member 820 becomes substantially equal to that measured from the pressure sensor 830 to the attachment position A of the heater 150. Therefore, elongation of the heater-holding member 820 is maintained substantially unchanged from the low temperature state, and the pre-load acting on the pressure sensor 830 is substantially the same as in the low temperature state.

FIG. 5(*c*) shows the pressure detection mechanism 800*c* (comparative example) in which the coefficient of thermal expansion of a displacement transmission member 840*c* is rendered roughly equal to that of the sensor-holding member 810. The mechanism shown in FIG. 5(*c*) is identical with that shown in FIG. 5(*b*), except that the coefficient of thermal expansion of the displacement transmission member 840*c* is smaller than that of the displacement transmission member 840 of the pressure detection mechanism 800 of the first embodiment.

As shown in FIG. 5(*c*), in the case where the coefficient of thermal expansion of the displacement transmission member 840 is rendered roughly equal to that of the sensor-holding member 810, the attachment position A of the heater 150, at which the heater 150 is attached to the heater-holding member 820, does not move to a position corresponding to the elongation of the sensor-holding member 810. Therefore, the axial length of the heater-holding member 820 becomes shorter, and elongation of the heater-holding member 820 decreases. When elongation of the heater-holding member 820 decreases, the force applied from the front end of the heater-holding member 820 to the heater 150 decreases, so that the load acting on the pressure sensor 830 decreases. Further, depending on the structure of the pressure detection mechanism 800*c*, a pulling force acts on the pressure sensor 830, whereby the pressure sensor 830 may break.

In contrast, in the first embodiment, the coefficient of thermal expansion of the displacement transmission member 840, which transmits the displacement of the heater 150 to the pressure sensor 830, is rendered greater than that of the sensor-holding member 810. In particular, this arrangement compensates for the difference in coefficient of thermal expansion between the sensor-holding member 810 and the heater 150. Thus, even at high temperature, the heater-holding member 820 is elongated by substantially the same amount as in the low temperature state, and the pre-load applied to the pressure sensor 830 is maintained at substantially the same level as in the low temperature state. Therefore, according to the first embodiment, a decrease in the pre-load applied to the pressure sensor 830 stemming from a temperature rise is suppressed, and the accuracy of pressure detection by the pressure sensor 830 can be improved. Further, since application of a pulling force to the pressure sensor 830 is suppressed, breakage of the pressure sensor 830 is prevented.

Notably, in the first embodiment, axial displacement of the heater 150 is permitted by the heater-holding member 820 whose axial length changes accordingly. However, in general, the heater-holding member 820 may assume any shape, so long as the heater-holding member 820 can hold the heater 150 in such a manner that the heater 150 can displace in the axial direction. For example, the heater-holding member 820 may be a member assuming the form of a flat plate and extending perpendicular to the axial direction, so that the heater-holding member 820 allows for axial displacement of the heater 150 through bending of the heater-holding member 820.

B1. Front-End Structure of the Second Embodiment

Figure 6:
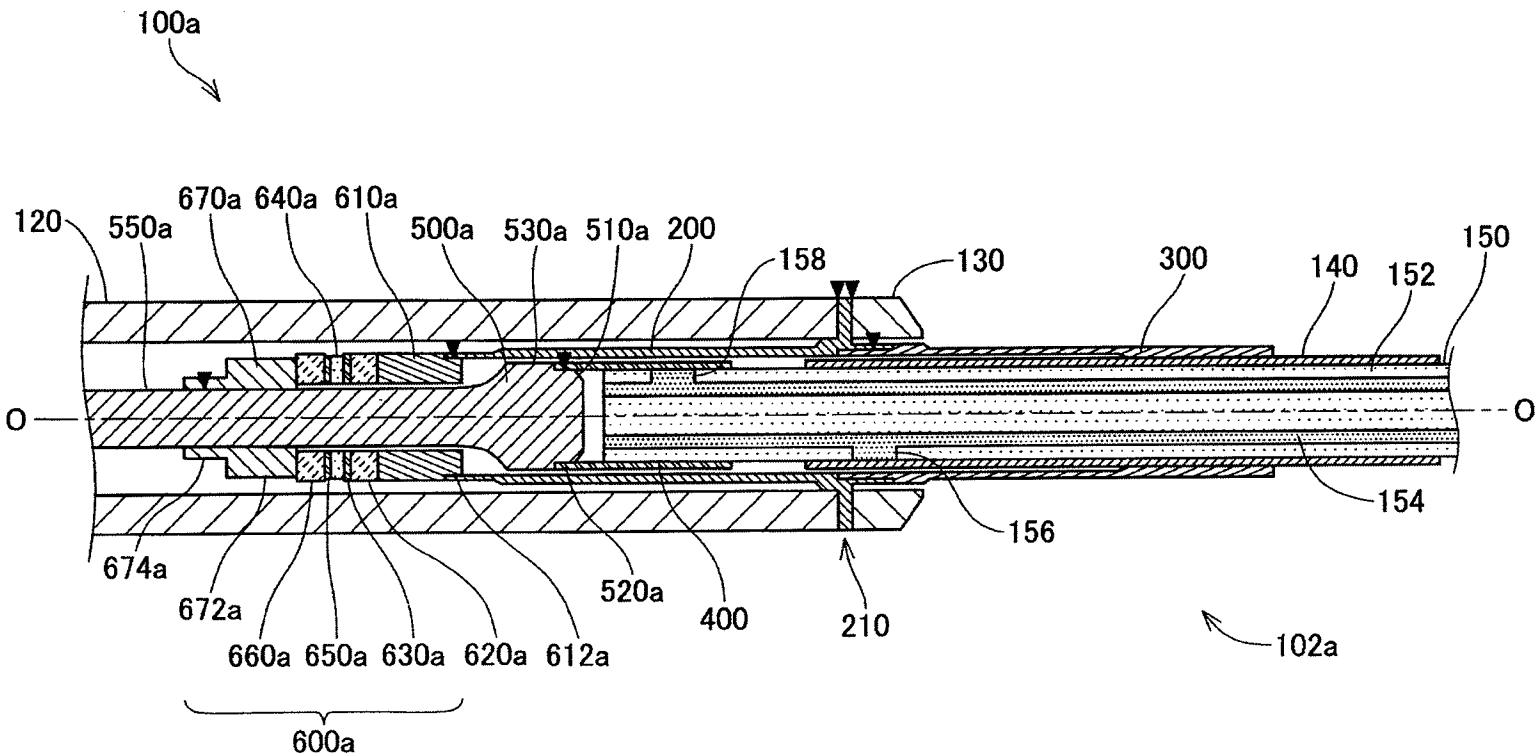
FIG. 6 is a sectional view showing the configuration of a front-end structure of the glow plug of a second embodiment of the invention.

FIG. 6 is a sectional view showing the configuration of a front-end structure 102*a* of a glow plug 100*a* of the second embodiment. The glow plug 100*a* of the second embodiment is identical to the glow plug 100 of the first embodiment shown in FIG. 2, except that the shape of a center shaft 500*a* differs from that of the center shaft 500, and the configuration of a sensor unit 600*a* differs from that of the sensor unit 600.

As in the case of the center shaft 500 in the first embodiment shown in FIG. 3, the center shaft 500*a* includes a taper portion 510*a*, a mating portion 520*a*, and a trunk portion 530*a*. However, the center shaft 500*a* of the second embodiment differs from the center shaft 500 of the first embodiment in that a sensor abutment portion 540 is not provided, and a shaft portion 550*a* extends from the trunk portion 530*a*. The shaft portion 550*a* has an approximately constant outer diameter smaller than that of the trunk portion 530*a*.

The sensor unit 600*a* of the second embodiment includes an element base member 610*a*, a first insulative block 620*a*, a first electrode plate 630*a*, a sensor element 640*a*, a second electrode plate 650*a*, a second insulative block 660*a* and an element-retaining member 670*a*, which are stacked in this sequence. The insulative blocks 620*a* and 660*a*, the electrode plates 630*a* and 650*a*, and the sensor element 640*a* are each formed in the shape of a disk whose inner diameter is greater than the outer diameter of the shaft portion of the center shaft 500*a*. Notably, the materials of these members can be the same as those of the corresponding members of the first embodiment.

The element base member 610*a* is a tubular member whose inner diameter is greater than the diameter of the shaft portion of the center shaft 500*a*. Like the sensor casing 610 of the first embodiment, the element base member 610*a* is formed of SUS430. Notably, the element base member 610*a* may be formed of a different material. A sleeve joint portion 612*a* whose outer diameter is approximately equal to the inner diameter of the front-end sleeve 200 is formed at the front end of the element base member 610*a*. The sleeve joint portion 612*a* and the front-end sleeve 200 are joined by inserting the sleeve joint portion 612*a* into the front-end sleeve 200 and laser welding from the radial outer side of the front-end sleeve 200 at a position indicated by a black triangle.

The element-retaining member 670*a* of the sensor unit 600*a* is a tubular member whose inner diameter is approximately equal to the diameter of the shaft portion of the center shaft 500*a*. Like the element-retaining member 670 of the first embodiment, the element-retaining member 670*a* is formed of SUS430. The element-retaining member 670*a* includes a larger diameter portion 672*a* formed at the front end side, and a smaller diameter portion 674*a* formed at the rear end side. The center shaft 500*a* and the element-retaining member 670*a* are joined by laser welding from the radial outer side of the smaller diameter portion 674*a* at a location indicated by a black triangle. The center shaft 500*a* and the element-retaining member 670*a* are joined in a state in which a pre-load directing toward the front end is applied to the element-retaining member 670*a*. Thus, as in the case of the sensor element 640 of the first embodiment, the sensor element 640*a* is fixed while a pre-load is applied thereto.

In the glow plug 100*a* of the second embodiment, when the heater 150 displaces toward the rear end side as a result of an increase in pressure in the combustion chamber, a rearward force is applied to the rear end of the sensor element 640*a* via the ring 400, the center shaft 500*a* and the element-retaining member 670*a*. The pressure is detected on the basis of a decrease in load acting on the sensor element 640*a*. That is, according to the pressure detection mechanism of the second embodiment, the pressure increase is detected from relief of the pre-load applied to the sensor element 640*a*. Therefore, the pressure detection mechanism of the second embodiment is also called a "relief-type pressure sensor."

B2. Influence of Temperature Rise in the Second Embodiment

Figures 7A, 7B, 7C:
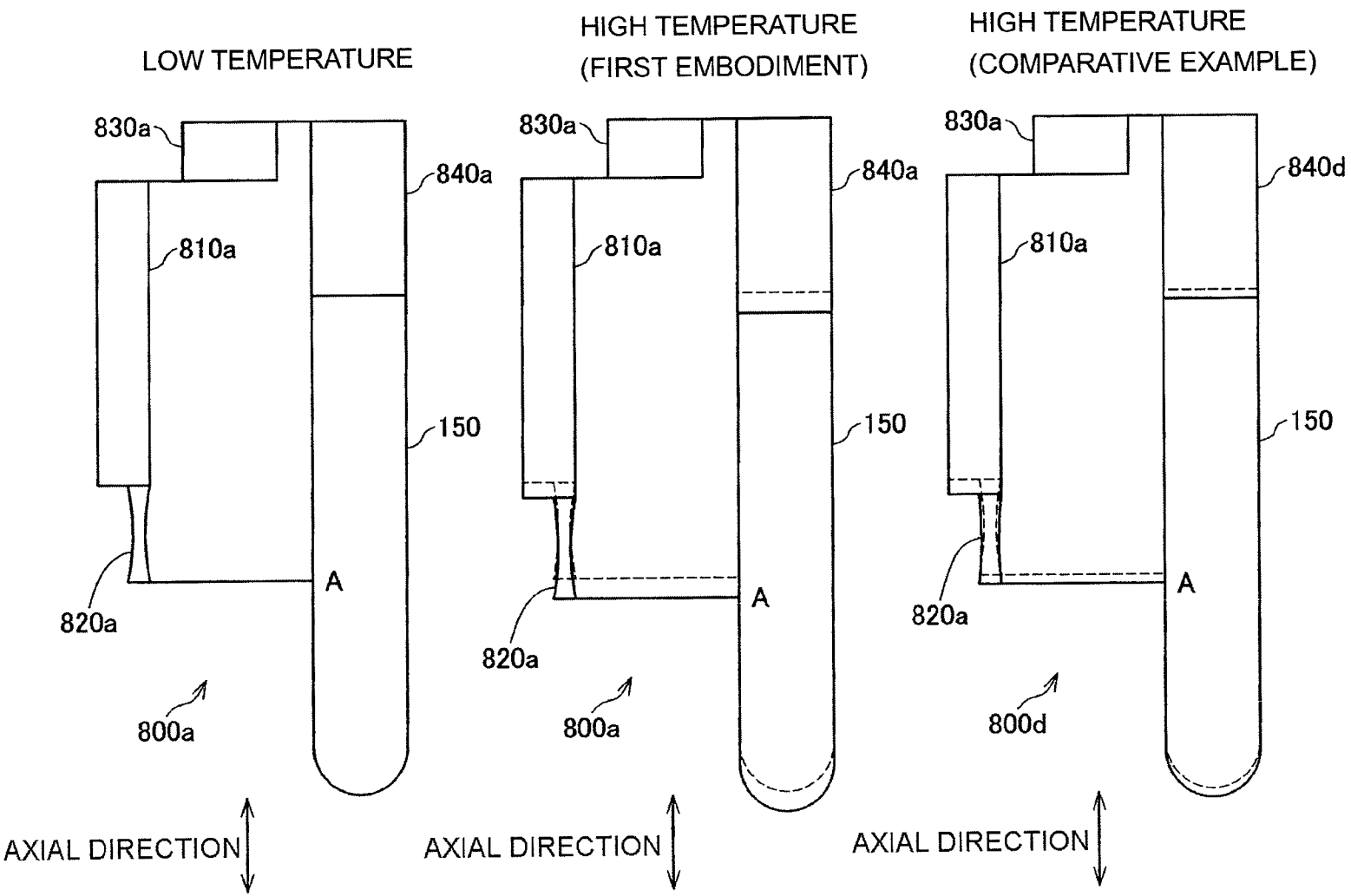
FIG. 7(*a*)-7(*c*) are explanatory views schematically showing the influence of temperature rise of the glow plug on a pressure detection mechanism of the second embodiment.

FIGS. 7(*a*) to 7(*c*) are explanatory views schematically showing an influence of temperature rise of the glow plug on the pressure detection mechanism in the second embodiment. In order to facilitate understanding, FIGS. 7(*a*) to 7(*c*) show pressure detection mechanisms 800*a* and 800*d*, which correspond to the font-end structure 102*a* (FIG. 6) but are simplified. FIG. 7(*a*) shows the state of the pressure detection mechanism 800*a* of the second embodiment at a low temperature. FIG. 7(*b*) shows the state of the pressure detection mechanism 800*a* of the second embodiment at a high temperature (solid lines) and the state of the pressure detection mechanism 800*a* at the low temperature (broken lines). FIG. 7(*c*) shows the state of the pressure detection mechanism 800*d* of a comparative example at a high temperature (solid lines) and the state of the pressure detection mechanism 800*d* at the low temperature (broken lines).

As shown in FIG. 7(*a*), the pressure detection mechanism 800*a* of the second embodiment is mainly composed of a sensor-holding member 810*a*, a heater-holding member 820*a*, a pressure sensor 830*a*, a displacement transmission member 840*a*, and the heater 150, similar to the first embodiment shown in FIG. 5(*a*). The pressure detection mechanism 800*a* of the second embodiment is identical to the pressure detection mechanism 800 of the first embodiment, except that the sensor-holding member 810*a* fixes, at its rear end, the position of the front end of the pressure sensor 830*a*, and the displacement transmission member 840*a* and the pressure sensor 830*a* are fixed to each other at their rear ends.

When the temperature increases from the low temperature state shown in FIG. 7(*a*), as shown in FIG. 7(*b*), the members which constitute the pressure detection mechanism 800 thermally expand. In the pressure detection mechanism 800*a* of the second embodiment, the coefficient of thermal expansion of the displacement transmission member 840*a* is rendered greater than that of the sensor-holding member 810*a*, as in the case of the pressure detection mechanism 800 of the first embodiment. Therefore, elongation of the sensor-holding member 810*a* is suppressed, and elongation of the displacement transmission member 840*a* increases. Thus, even at high temperature, the length as measured from the rear end of the pressure sensor 830*a* to the front end of the heater-holding member 820*a* becomes substantially equal to that measured from the rear end of the displacement transmission member 840*a* to the attachment position A of the heater 150. Therefore, elongation of the heater-holding member 820*a* remains substantially unchanged from the low temperature state, and the pre-load acting on the pressure sensor 830*a* is substantially the same as that at the low temperature state.

FIG. 7(*c*) shows the pressure detection mechanism 800*d* (comparative example) in which the coefficient of thermal expansion of a displacement transmission member 840*d* is rendered roughly equal to that of the sensor-holding member 810*a*. The mechanism shown in FIG. 7(*c*) is identical with that shown in FIG. 7(*b*), except that the coefficient of thermal expansion of the displacement transmission member 840*d* is smaller than that of the displacement transmission member 840*a* of the pressure detection mechanism 800*a* of the second embodiment.

As shown in FIG. 7(*c*), in the case where the elongation of the heater 150 is small, and the elongation of the displacement transmission member 840*d* is roughly equal to that of the sensor-holding member 810*a*, the attachment position A of the heater 150 does not move to a position corresponding to elongation of the sensor-holding member 810*a*. Therefore, the axial length of the heater-holding member 820*a* becomes shorter, and elongation of the heater-holding member 820*a* decreases. When elongation of the heater-holding member 820*a* decreases, the rearward force applied from the front end of the heater-holding member 820*a* to the heater 150 decreases, so that the load acting on the pressure sensor 830*a* increases. Further, depending on the structure of the pressure detection mechanism 800*d*, an excessively large compression force acts on the pressure sensor 830*a*, whereby the pressure sensor 830*a* may be broken.

In contrast, in the second embodiment, the coefficient of thermal expansion of the displacement transmission member 840*a*, which transmits the displacement of the heater 150 to the pressure sensor 830*a*, is rendered greater than that of the sensor-holding member 810*a*. Consequently, such arrangement compensates for the difference in coefficient of thermal expansion between the sensor-holding member 810*a* and the heater 150. Thus, even at high temperature, the heater-holding member 820*a* is elongated by substantially the same amount as in the low temperature state, and the pre-load applied to the pressure sensor 830*a* is maintained at substantially the same level as in the low temperature state. Therefore, according to the second embodiment, an increase in the pre-load applied to the pressure sensor 830*a* stemming from a temperature rise is suppressed, and accuracy of pressure detection by the pressure sensor 830*a* can be improved. Further, since application of an excess compression force to the pressure sensor 830*a* is suppressed, breakage of the pressure sensor 830*a* is prevented.

C. Measurement of Coefficient of Thermal Expansion

The coefficient of thermal expansion of a test piece can be measured using a temperature control unit for controlling the temperature of the test piece to be measured, and a displacement gauge for measuring a change in a dimension of the test piece. The temperature control unit is composed of, for example, a heater for heating the test piece and a temperature regulator for maintaining the test piece at a predetermined temperature. The displacement gauge may be an optical-type displacement gauge using a laser. The measurement of the coefficient of thermal expansion is performed in such manner that the test piece is fixed to the temperature control unit by use of a jig having a shape which does not hinder the measurement of dimensional change by the displacement and the temperature of the test piece is changed. The coefficient of thermal expansion can be obtained from a change in the temperature of the test piece and a dimensional change attributable to the temperature change. The coefficient of thermal expansion in the room temperature environment can be measured by changing the temperature within a range including room temperature (25° C.). In this case, depending on the temperature of the measurement environment, a cooling mechanism (e.g., a Peltier cooling element or a refrigerator) is provided. Further, the room-temperature thermal expansion coefficient can be obtained by extrapolation from coefficients of thermal expansion measured at a plurality of temperatures higher than room temperature.

It should further be apparent to those skilled in the art that various changes in form and detail of the invention as shown and described above may be made. It is intended that such changes be included within the spirit and scope of the claims appended hereto.

This application is based on Japan Patent Application Nos. 2008-87767 and 2009-23 filed Mar. 28, 2008 and Jul. 5, 2009, respectively, incorporated herein by reference in their entirety.

What is claimed is:

1. A glow plug comprising a pressure sensor and a heater, the glow plug further comprising:

a position-defining member which defines a positional relationship between the pressure sensor and the heater, and which has a coefficient of thermal expansion greater than that of the heater, wherein the pressure sensor is fixed at a predetermined sensor reference position relative to the position-defining member;

the heater is held by a heater-holding member in such manner that an attachment position of the heater-holding member to the heater is displaceable, with a change in external pressure, relative to a heater reference position defined by the position-defining member; and a displacement transmission member whose coefficient of thermal expansion is greater than that of the position-defining member is arranged between the heater and the pressure sensor so as to transmit displacement of the heater to the pressure sensor, wherein the heater-holding member is fixed to the housing, holds the heater, and deforms so as to permit displacement of the attachment position relative to the heater reference position along a direction of an axis connecting first and second ends of the housing.

2. The glow plug according to claim 1, further comprising: a tubular housing accommodating the pressure sensor, the heater being provided at a first end of the housing and being formed mainly of ceramic; and a sensor-holding member fixed to the housing and which accommodates and holds the pressure sensor, and wherein the sensor-holding member has a coefficient of thermal expansion greater than that of the heater and less than that of the displacement transmission member.

3. The glow plug according to claim 2, wherein the heater-holding member allows for displacement of the attachment position with a change in length of the heater-holding member in the axial direction; and the coefficient of thermal expansion of the heater-holding member is greater than that of the heater and less than that of the displacement transmission member.

4. The glow plug according to claim 2, wherein the sensor-holding member includes:

a tubular portion accommodated in the housing and fixed to the housing at one end of the tubular portion corresponding to the first end of the housing; and a sensor fixing portion provided at the other end of the tubular portion corresponding to the second end of the housing, and which restricts movement of the pressure sensor at one end of the pressure sensor corresponding to the second end of the housing, to thereby fix the pressure sensor, wherein the displacement transmission member inserted into the tubular portion transmits the displacement to the pressure sensor at the other end of the pressure sensor corresponding to the first end of the housing.

5. The glow plug according to claim 3, wherein the sensor-holding member includes:

a tubular portion accommodated in the housing and fixed to the housing at one end of the tubular portion corresponding to the first end of the housing; and a sensor fixing portion provided at the other end of the tubular portion corresponding to the second end of the housing, and which restricts movement of the pressure sensor at one end of the pressure sensor corresponding to the second end of the housing, to thereby fix the pressure sensor, wherein the displacement transmission member inserted into the tubular portion transmits the displacement to the pressure sensor at the other end of the pressure sensor corresponding to the first end of the housing.

6. The glow plug according to claim 2, wherein the sensor-holding member includes a tubular portion accommodated in the housing and fixed to the housing at one end of the tubular portion corresponding to the first end of the housing; and a sensor fixing portion provided at the other end of the tubular portion corresponding to the second end of the housing, and which restricts movement of the pressure sensor at one end of the pressure sensor corresponding to the first end of the housing, to thereby fix the pressure sensor, wherein the displacement transmission member inserted into the tubular portion transmits the displacement to the pressure sensor at the other end of the pressure sensor corresponding to the second end of the housing.

7. The glow plug according to claim 3, wherein the sensor-holding member includes a tubular portion accommodated in the housing and fixed to the housing at one end of the tubular portion corresponding to the first end of the housing; and a sensor fixing portion provided at the other end of the tubular portion corresponding to the second end of the housing, and which restricts movement of the pressure sensor at one end of the pressure sensor corresponding to the first end of the housing, to thereby fix the pressure sensor, wherein the displacement transmission member inserted into the tubular portion transmits the displacement to the pressure sensor at the other end of the pressure sensor corresponding to the second end of the housing.

8. The glow plug according to claim 1, wherein the position-defining member is formed of a low thermal expansion material having a coefficient of thermal expansion of 9 ppm/° C. or less at room temperature.

9. The glow plug according to claim 1, wherein the displacement transmission member is formed of a high thermal expansion material having a coefficient of thermal expansion of 16 ppm/° C. or greater at room temperature.

10. The glow plug according to claim 2, wherein the housing includes a fastening portion for attachment to an internal combustion engine; and the sensor-holding member is fixed at a position between the fastening portion and the first end of the housing.

* * * * *